US008985335B1

(12) United States Patent
Fisher

(10) Patent No.: US 8,985,335 B1
(45) Date of Patent: Mar. 24, 2015

(54) MAGNETICALLY MOUNTABLE TRAY DEVICE

(71) Applicant: Stephen J. Fisher, Los Gatos, CA (US)

(72) Inventor: Stephen J. Fisher, Los Gatos, CA (US)

( * ) Notice: Subject to any disclaimer, the term of this patent is extended or adjusted under 35 U.S.C. 154(b) by 0 days.

(21) Appl. No.: 14/181,364

(22) Filed: Feb. 14, 2014

Related U.S. Application Data

(60) Provisional application No. 61/766,598, filed on Feb. 19, 2013, provisional application No. 61/804,776, filed on Mar. 25, 2013.

(51) Int. Cl.
*A45C 13/00* (2006.01)
*B65D 1/34* (2006.01)

(52) U.S. Cl.
CPC ..... *B65D 1/34* (2013.01)
USPC ..... 206/557; 211/42

(58) Field of Classification Search
USPC ..... 206/350, 349; 211/42, 43, DIG. 1, 86.01
See application file for complete search history.

(56) References Cited

U.S. PATENT DOCUMENTS

| | | | | |
|---|---|---|---|---|
| 3,964,193 | A * | 6/1976 | Degenhardt et al. | 40/367 |
| RE36,827 | E * | 8/2000 | Belokin et al. | 211/75 |
| 6,318,569 | B1 * | 11/2001 | Rothing | 211/90.01 |
| 2003/0062279 | A1 * | 4/2003 | Lam | 206/350 |
| 2004/0200080 | A1 * | 10/2004 | Lauri | 30/541 |
| 2013/0155657 | A1 * | 6/2013 | Werner et al. | 362/154 |

* cited by examiner

*Primary Examiner* — Steven A. Reynolds
*Assistant Examiner* — King M Chu

(57) ABSTRACT

Magnetically mountable tray device are presented including: a mounting plate having a front planar surface and a back planar surface; a number of mounting magnets positioned along the back planar surface; a base plate having a top planar surface and a bottom planar surface; a hinge mechanically coupled along a back edge of the base plate and along the front planar surface of the mounting plate; and a support element positioned along the bottom planar surface and mechanically coupled thereto, where the support element is positioned to contact the front surface of the mounting plate when the magnetically mountable tray device is in an open position. In some embodiments, magnetically mountable tray devices further include: a closure magnet positioned along the front planar surface; and a closure tab positioned along the top planar surface.

12 Claims, 6 Drawing Sheets

MAGNETICALLY MOUNTABLE TRAY DEVICE

BACKGROUND

The present invention relates generally to portable tool trays for holding tools, electronic equipment, and materials while also providing a work space which can be magnetically attached to a variety of steel surfaces such as mechanical equipment panels, automobile side panels, metal studs, steel doors, or refrigerator doors for example.

When working with tools and electronic equipment such as laptops or meters in on-site applications a problem often exists that workers have only limited or inconvenient places to keep their tools and materials separated and organized. In addition, in many on-site locations such as in power distribution systems, there may also be insufficient or hazardous work areas. Typically, workmen leave tools and materials on any flat surface that may be conveniently reached when working on rooftops, near mechanical equipment, or on ground or floor mechanical rooms and garages. This practice often poses safety hazards because workmen or other persons can trip on the tools and damage sensitive and expensive equipment. In addition, the lack of a suitable work surface from which to assemble components or utilize a laptop computer may decrease efficient repair operations. In some environments, a workman may attempt to field fabricate a workbench or tool holder out of sheetrock, plywood, or cardboard. Utilizing these materials may create additional hazards for a workman as these materials are generally unstable and may unexpectedly spill tools and instruments placed on them. As such, magnetically mountable tray devices are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Magnetically mountable tray device are presented including: a mounting plate having a front planar surface and a back planar surface; a number of mounting magnets positioned along the back planar surface; a base plate having a top planar surface and a bottom planar surface; at least one hinge mechanically coupled along a back edge of the base plate and along the front planar surface of the mounting plate; and at least one support element positioned along the bottom planar surface and mechanically coupled thereto, where the at least one support element is positioned to contact the front surface of the mounting plate when the magnetically mountable tray device is in an open position. In some embodiments, magnetically mountable tray devices further include: a closure magnet positioned along the front planar surface; and a closure tab positioned along the top planar surface and further positioned to engaged the closure magnet when the magnetically mountable tray device is in a closed position. In some embodiments, magnetically mountable tray devices further include: a number of capture magnets positioned along and co-planar with the top planar surface. In some embodiments, magnetically mountable tray devices further include: a number of through-holes positioned along and through the top planar surface. In some embodiments, magnetically mountable tray devices further include: a number of tray indents positioned along the top planar surface. In some embodiments, the mounting plate and the base plate is manufactured from a material selected from the group consisting of: a non-electrically conductive material, a rigid polymeric material, a semi-rigid polymeric material, a rigid fibrous material, a semi-rigid fibrous material, and a non-ferrous metal material. In some embodiments, the base plate further includes a cushioning layer affixed with and at least partially covering the top planar surface.

In other embodiments, methods for utilizing a magnetically mountable tray device are provided including: providing the magnetically mountable tray device, the magnetically mountable tray device including, a mounting plate having a front planar surface and a back planar surface, a number of mounting magnets positioned along the back planar surface, a base plate having a top planar surface and a bottom planar surface, at least one hinge mechanically coupled along a back edge of the base plate and along the front planar surface of the mounting plate, and at least one support element positioned along the bottom planar surface and mechanically coupled thereto, where the at least one support element is positioned to contact the front surface of the mounting plate when the magnetically mountable tray device is in an open position; attaching the magnetically mountable tray device to a magnetically receptive surface; and moving the magnetically mountable tray device to the open position. In some embodiments, methods further include: grasping the base plate; removing the magnetically mountable tray device from the magnetically receptive surface, and closing the magnetically mountable tray device. In some embodiments, methods further include: receiving a magnetically receptive element along any of a number of capture magnets positioned along and co-planar with the top planar surface. In some embodiments, methods further include: receiving a first object along any of a number of through-holes positioned along and through the top planar surface. In some embodiments, methods further include: receiving a second object along any of a number of tray indents positioned along the top planar surface.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

It is an object of present embodiments to provide a magnetically mountable tray device for securing tools and materials. It is an additional object of present embodiments to provide a magnetically mountable tray device for use as a portable workbench type of work area. Another object of present embodiments is to provide a magnetically active work and tool tray that may be attached to magnetically receptive surfaces. Still another object of present embodiments is to provide an ergonomic solution for lifting and transporting tools and materials from one work station to another. A further object of present embodiments is to provide magnets in different positions on the mounting plate which enables positioning the device on many different steel surfaces such as those found on mechanical and industrial equipment for example. Another important object of present embodiments is to enable the user to stand in an ergonomically correct position when retrieving tools and to assemble parts while working on rooftop or other mechanical equipment by placement at waist level on a side or a door of said equipment. Still another important object of present embodiments is to provide various size through-holes to insert tools such as screw and nut drivers, hammers and drill motors for example. An additional object of present embodiments is to provide tray indents on the top surface to provide temporary storage of screws and other materials. Still another object of present embodiments is to provide tray indents for placing a cup or bottled beverage. A further object of present embodiments is to provide tray indents in the center area for placement of paint cans and or pails for example. Yet another object of present embodiments is to provide a temporary or semi-permanent use application. Still another object of present embodiments to provide capture magnets placed into or attached to the top surface or the front surface of the mounting plate to secure loose screws, bolts, washers, and tools. One further object of present embodiments is provide a folding work surface when not in use or for storage and transportation.

Figure 1:
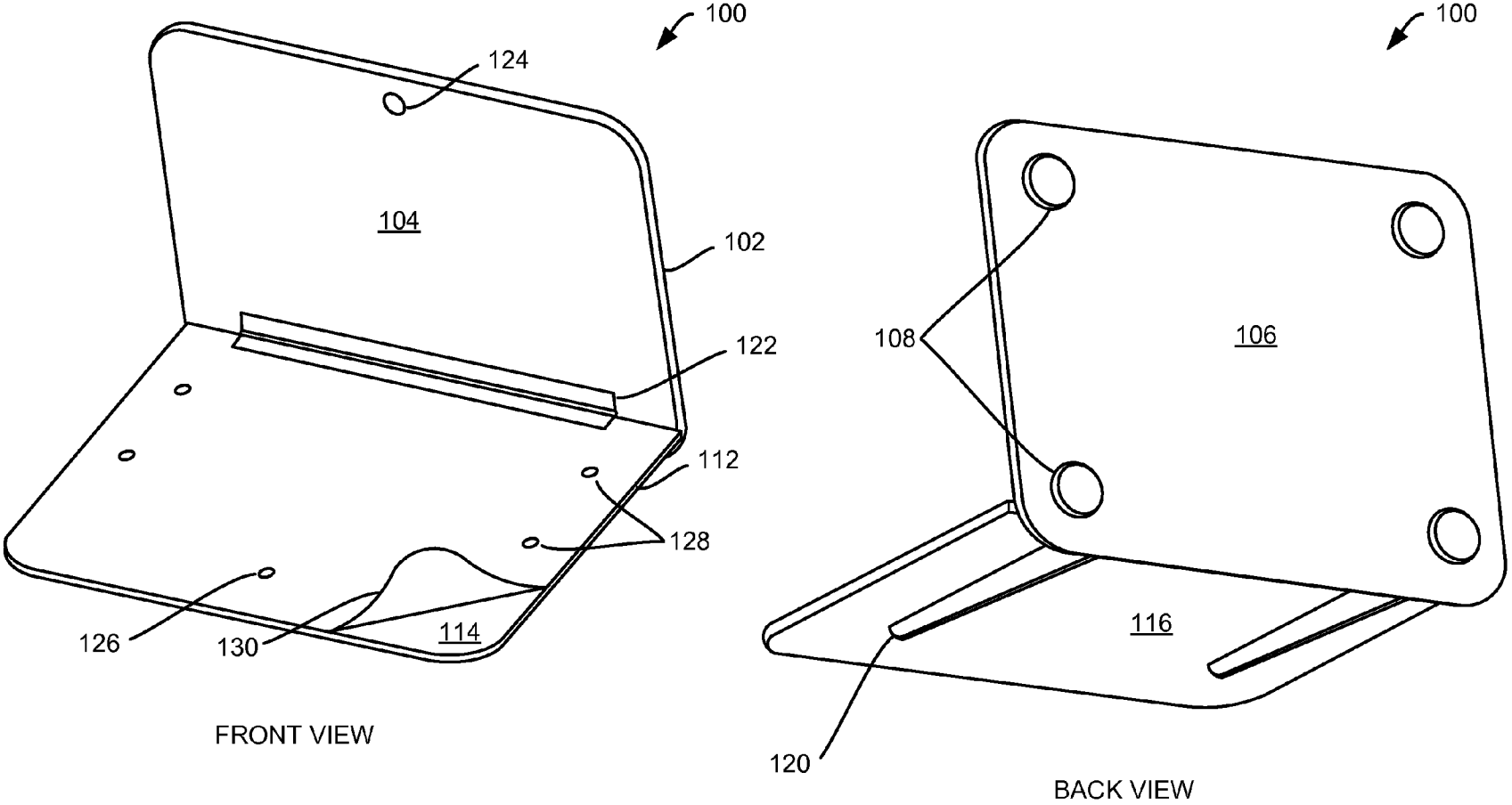
FIG. 1 is an illustrative representation of a magnetically mountable tray device in accordance with embodiments of the present invention.

FIG. 1 is an illustrative representation of magnetically mountable tray device 100 in accordance with embodiments of the present invention. In particular, an orthogonal front view and back view are presented. As illustrated, magnetically mountable tray device 100 includes mounting plate 102 having front planar surface 104 and back planar surface 106. As may be seen back planar surface 106 may include a number of mounting magnets 108 positioned along back planar surface 106. Although four mounting magnets are illustrated, it may be appreciated that any number of mounting magnets may be utilized in any pattern or configuration without departing from embodiments provided herein. Further, the number and pattern of mounting magnets may be selected to provide a desired holding strength with a magnetically receptive surface. In some embodiments, any number of rare earth magnets such as neodymium magnets or samarium-cobalt magnets may be utilized. In other embodiments, an electromagnet may be utilized that may be powered from an attached power source. In some embodiments, at least four mounting magnets may be utilized. In some embodiments, mounting magnets may have a diameter of at least 0.50 inch and have a pulling force of at least 20 pounds each. In other embodiments, mounting magnets may have a diameter of at least 1.00 inch and have a pulling force of at least 50 pounds each.

Further illustrated is base plate 112 having top planar surface 114 and bottom planar surface 116. As may be seen bottom planar surface 116 may further include support element 120 mechanically coupled with bottom planar surface 116 and positioned to contact front surface 106 of mounting plate 102 when magnetically mountable tray device 100 is in a open position. Any number of supports may be utilized without departing from present embodiments. Support arrangements will be discussed in further detail below for FIGS. 4 and 5. In order to provide an open and closed position, hinge 122 is provided that is mechanically coupled along a back edge of base plate 112 and along front planar surface 104 of mounting plate 102. In some embodiments, mounting plate 102 may further include closure magnet 124 positioned along front planar surface 104. In addition, closure tab 126 may be positioned along top planar surface 114 and positioned to engage closure magnet 124 when the magnetically mountable tray device 100 is in a closed position. In other embodiments, any number of capture magnets 128 may be positioned along and co-planar with top planar surface 114. As noted above, any number of capture magnets may be utilized to receive any number of magnetically receptive elements such as, for example, loose screws, bolts, washers, and tools. In some embodiments, top planar surfaces may include an additional layer 130 affixed on top planar surfaces and manufactured from a polymeric material or a natural material that provides a cushioned surface. In some embodiments, the additional layer may be selected for "stickiness," or gripping strength. Utilizing additional layers may provide additional traction in a wet environment and may be desirable to hold tools when magnetically mountable tray devices are not levelly mounted.

In some embodiments, a mounting plate is at least approximately 6 inches wide by at least approximately 6 inches long, and a base plate is at least approximately 6 inches wide by at least approximately 6 inches long. In some embodiments, a mounting plate is at least approximately 8 inches wide by at least approximately 10 inches long, and a base plate is at least approximately 8 inches wide by at least approximately 10 inches long. In some embodiments, a mounting plate is at least approximately 12 inches wide by at least approximately 12 inches long, and a base plate is at least approximately 12 inches wide by at least approximately 12 inches long. In some embodiments, a mounting plate is at least approximately 24 inches wide by at least approximately 24 inches long, and a base plate is at least approximately 24 inches wide by at least approximately 24 inches long. In other embodiments, the mounting plate and the base plate is manufactured from a material such as: a non-electrically conductive material, a rigid polymeric material, a semi-rigid polymeric material, a rigid fibrous material, a semi-rigid fibrous material, and a non-ferrous metal material. In addition, mounting and base plate embodiments may be formed by any process such as blow molding, injection molding, extrusion molding, cutting, and routing without limitation.

In operation, magnetically mountable tray device 100 may be provided as illustrated. A user may then attach magnetically mountable tray device 100 to a magnetically receptive surface. Once magnetically mountable tray device 100 is secure, the device may be moved to an open position such as is illustrated in FIG. 1. A user may then utilize base plate 112 as a working surface or as a temporary storage surface. For example, the device may receive a magnetically receptive element along any of capture magnets 128 positioned along and co-planar with top planar surface 114. Magnetically receptive elements may include, for example, loose screws, bolts, washers, and tools. To remove magnetically mountable tray device 100, a user may grasp base plate 112 and remove magnetically mountable tray device 100 from the magnetically receptive surface. Grasping at the base plate may provide needed leverage to pry the device from the surface. Once magnetically mountable tray device 100 is removed from the magnetically receptive surface, the device may be closed for storage and transport.

Figure 2:
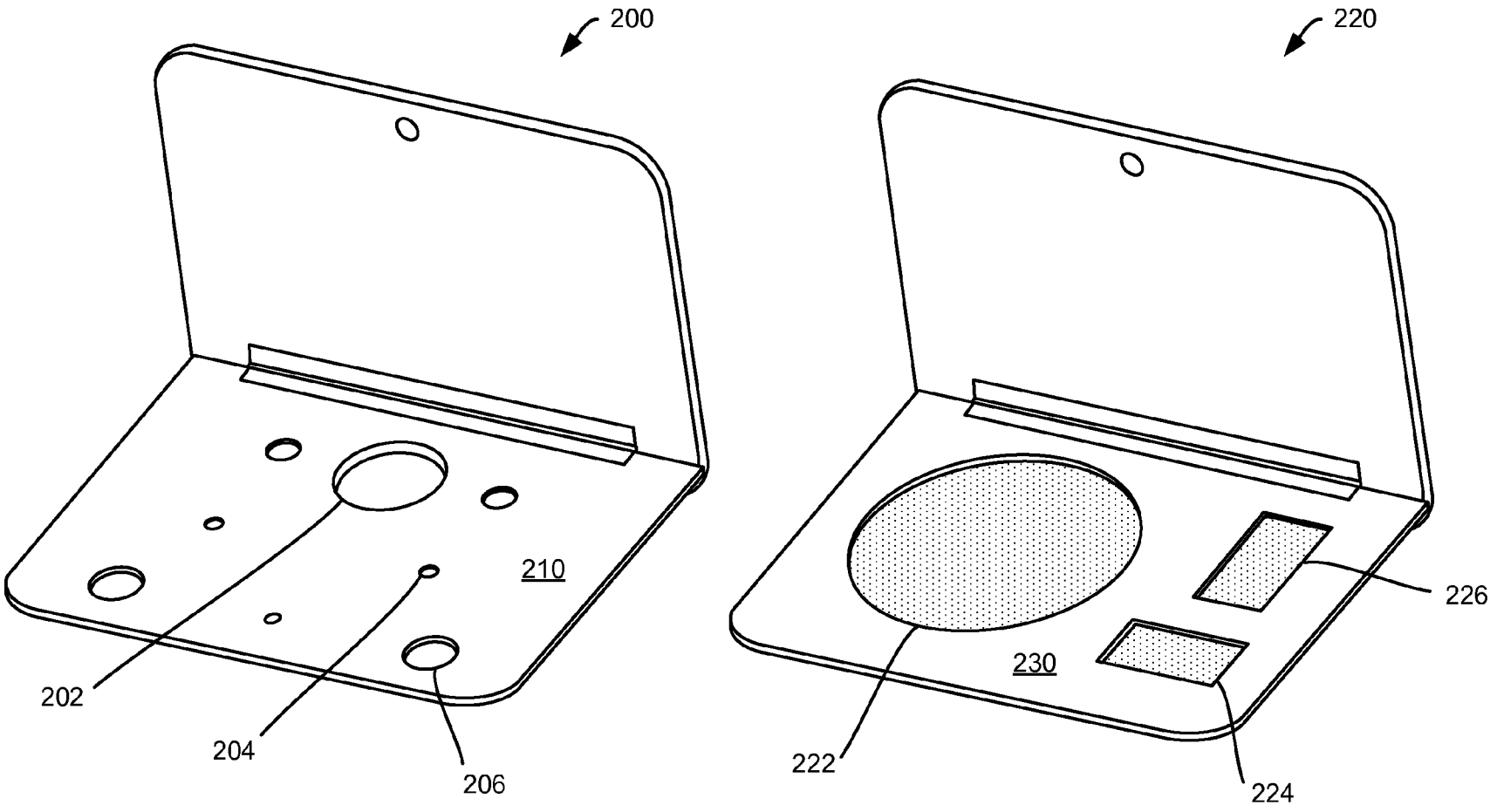
FIG. 2 is an illustrative representation of magnetically mountable tray devices in accordance with embodiments of the present invention.

FIG. 2 is an illustrative representation of magnetically mountable tray devices 200 and 220 in accordance with embodiments of the present invention. In particular, FIG. 2 illustrates different base plate configurations that may be desirable in embodiments. For example, magnetically mountable tray device 200 includes a number of through-holes 202, 204, and 206 of varying size and location positioned along top planar surface 210. As may be appreciated, though-holes may allow a user to insert tools such as screw and nut drivers, hammers, drill motors, and the like to keep tools within easy reach and out of the way. In operation, through-holes may receive any number of objects for temporary storage.

In another example, magnetically mountable tray device 220 includes a number of tray indents 222, 224, and 226 of varying size, depth, and location positioned along top planar surface 230. As may be appreciated, tray indents may allow a user to place containers, or other small items thereon to keep the objects within easy reach and out of the way. In some embodiments, tray indents may be numbered to provide an organizational component. In other embodiments, tray indents may further include a removable cover (not shown) for securing small items during transport. In operation, tray indents may receive any number of objects for temporary storage.

Although the examples provided illustrate either through-holes or tray indents in each embodiment, it may be appreciated that any suitable combination of through-holes, tray indents, and capture magnets (see FIG. 1) may be utilized without departing from embodiments herein. In some examples, these features may be customized to a particular repair and organized to keep components separate and in order of removal or installation. Furthermore, any size, location, or depth (in the case of tray indents) may be utilized without departing from embodiments provided herein. In some further examples, through-holes may include a flexible pocket (not shown) that may provide additional temporary storage while folding flat when magnetically mountable tray devices are in a closed position. In other embodiments, a through-hole may be positioned to provide a handle (see FIG. 4). In some embodiments tray indents may include magnetic elements or cushioning layers without limitation.

Figure 3:
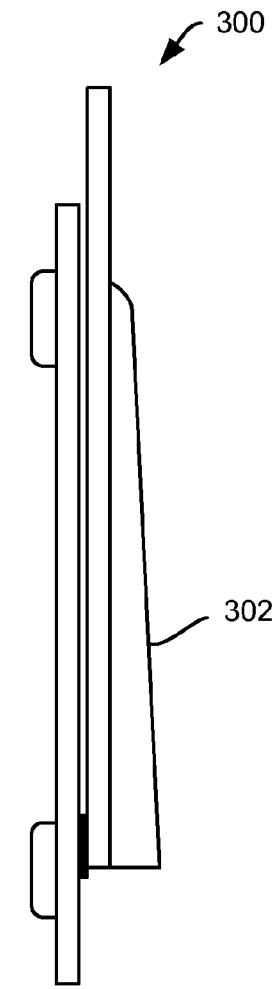
FIG. 3 is an illustrative representation of a magnetically mountable tray device in a closed position in accordance with embodiments of the present invention.
Figure 3:
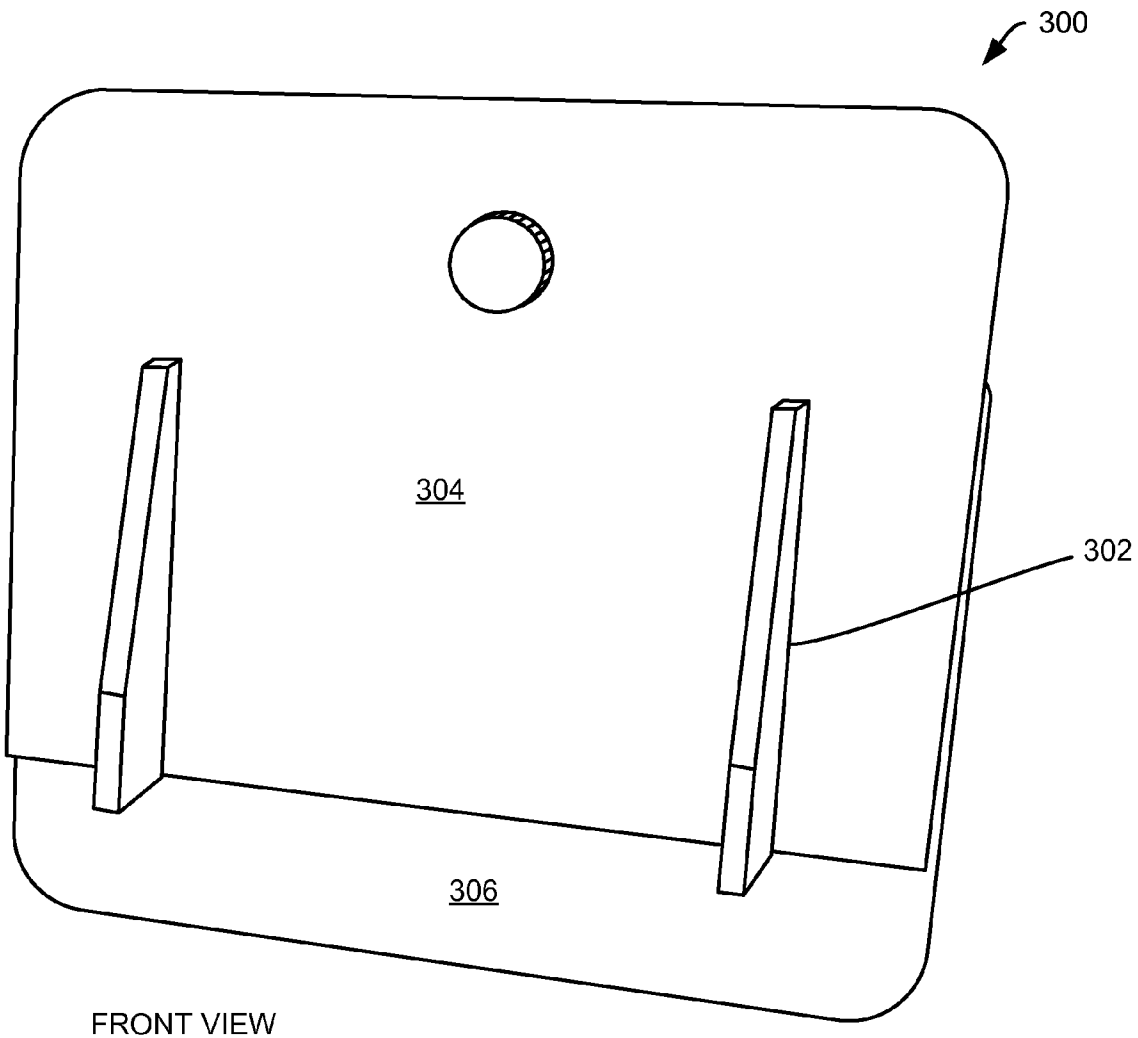

FIG. 3 is an illustrative representation of magnetically mountable tray device 300 in a closed position in accordance with embodiments of the present invention. In particular, a front view and side view is presented for clarity in understanding embodiments provided herein. As illustrated, bottom planar surface 304 may further include support element 302 mechanically coupled with bottom planar surface 304 and positioned to contact front surface 306 when magnetically mountable tray device 300 is in a open position. As illustrated, two supports are provided. However, any number of supports may be utilized without departing from present embodiments. In addition any suitably shaped support may be utilized without departing from embodiments herein. As may be seen in side view, support 302 extends away from bottom planar surface 304. In order to provide a more compact configuration, supports may be further configured to pivot toward bottom planar surfaces using a hinge for example. In still other embodiments, supports may be removable for storage and transport. As such supports may be mechanically coupled with bottom planar surfaces in any manner known in the art without departing from embodiments provided herein.

Figure 4:
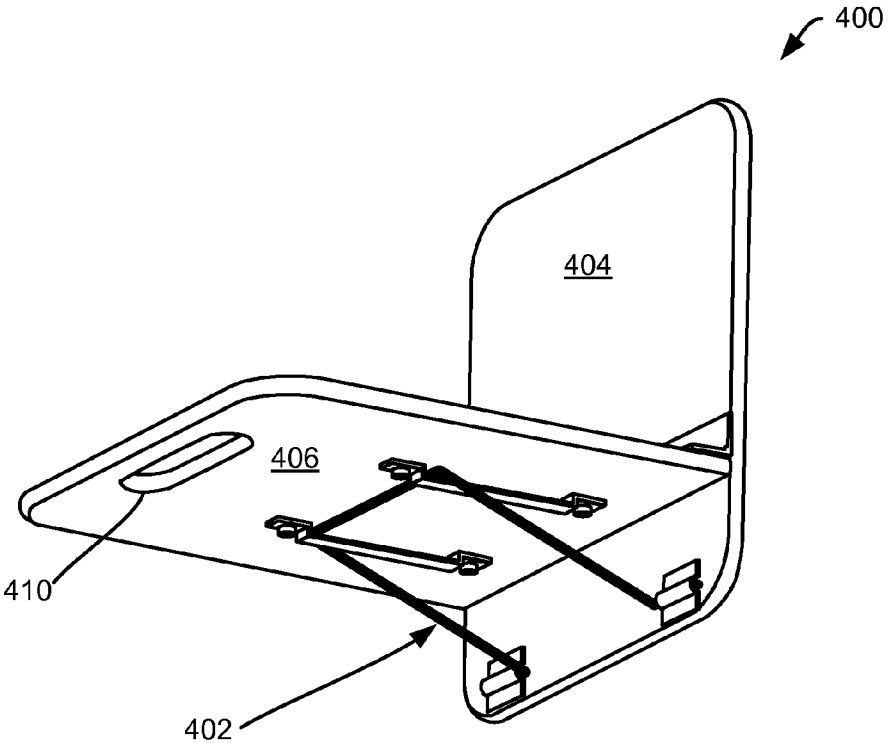
FIG. 4 is an illustrative representation of a magnetically mountable tray device in accordance with embodiments of the present invention.

FIG. 4 is an illustrative representation of magnetically mountable tray device 400 in accordance with embodiments of the present invention. In particular, FIG. 4 illustrates another example support embodiment that may be utilized. In this example support 402 may be pivotally coupled with front planar surface 404 and slidingly coupled with bottom planar surface 406. In this example support 402 may be effectively folded flat with bottom planar surface 406 when magnetically mountable tray device 400 is in a closed position. Further illustrated is through-hole 410, which may be positioned to provide a handle for magnetically mountable tray device 400 in a closed position or to provide a tool holder for magnetically mountable tray device 400 in an open position.

Figure 5:
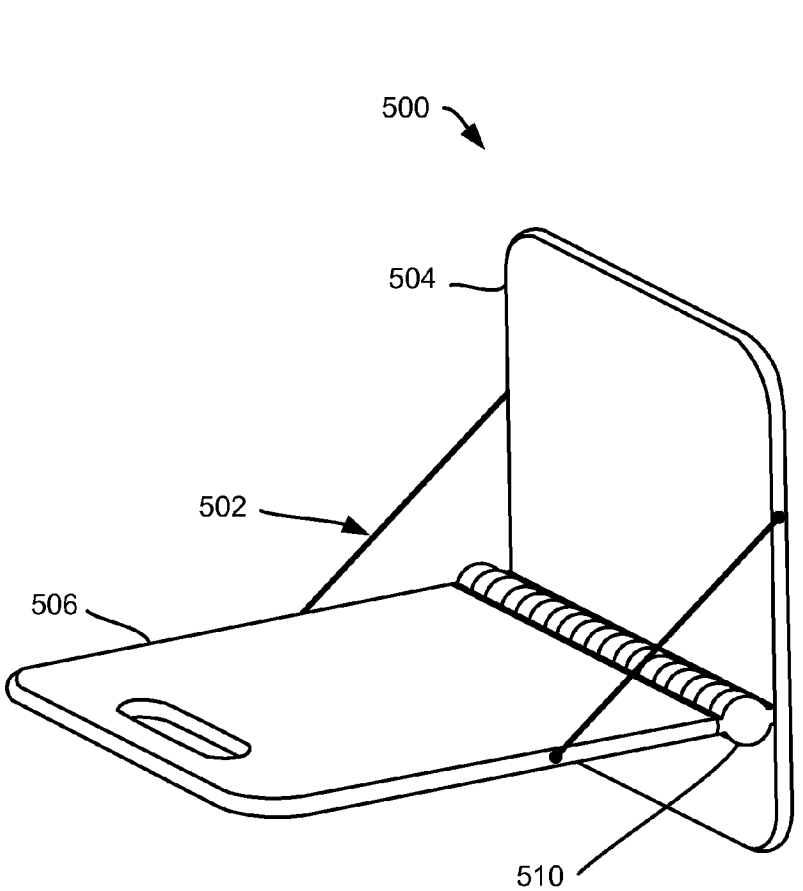
FIG. 5 is an illustrative representation of a magnetically mountable tray device in accordance with embodiments of the present invention.

FIG. 5 is an illustrative representation of magnetically mountable tray device 500 in accordance with embodiments of the present invention. In this example support 502 may be mechanically coupled with mounting plate 404 and with base plate 506. Support examples may include a cord, a string, a cable, a strap, a chain, or any other flexible or semi-flexible material. In some embodiments, support straps may be enabled with a rigid material and may be slidingly coupled with either the mounting plate or the base plate without limitation. In addition, barrel hinge 510 may be utilized to couple mounting plate 404 with base plate 506. In some examples barrel hinges may be utilized which include a number of stops so that the base plate may be selectively opened by degree. These embodiments may be useful when attaching mounting plates with overhead surfaces that are not level.

Figure 6:
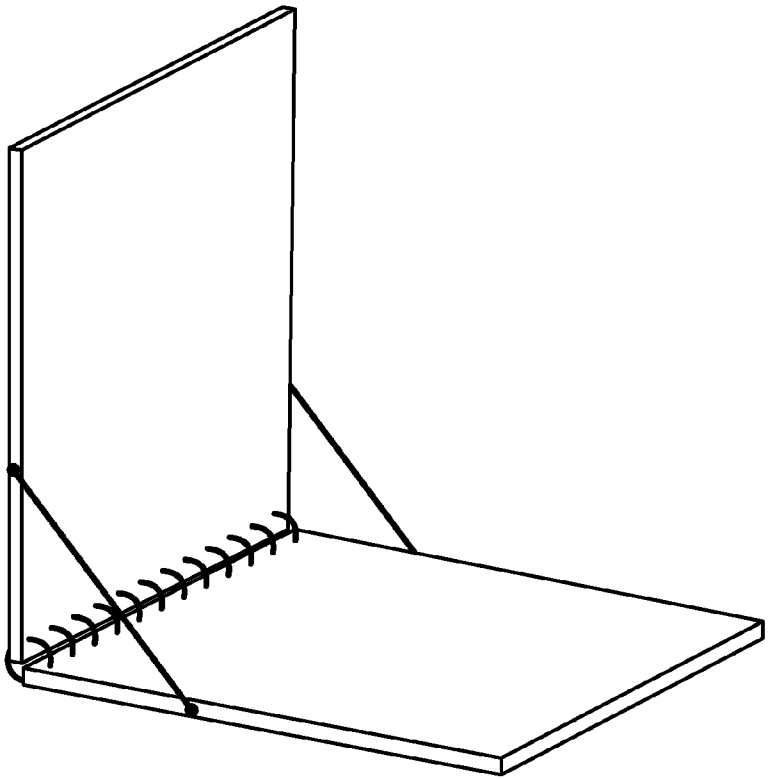
FIG. 6 is an illustrative representation of a magnetically mountable tray device in accordance with embodiments of the present invention.
Figure 6:
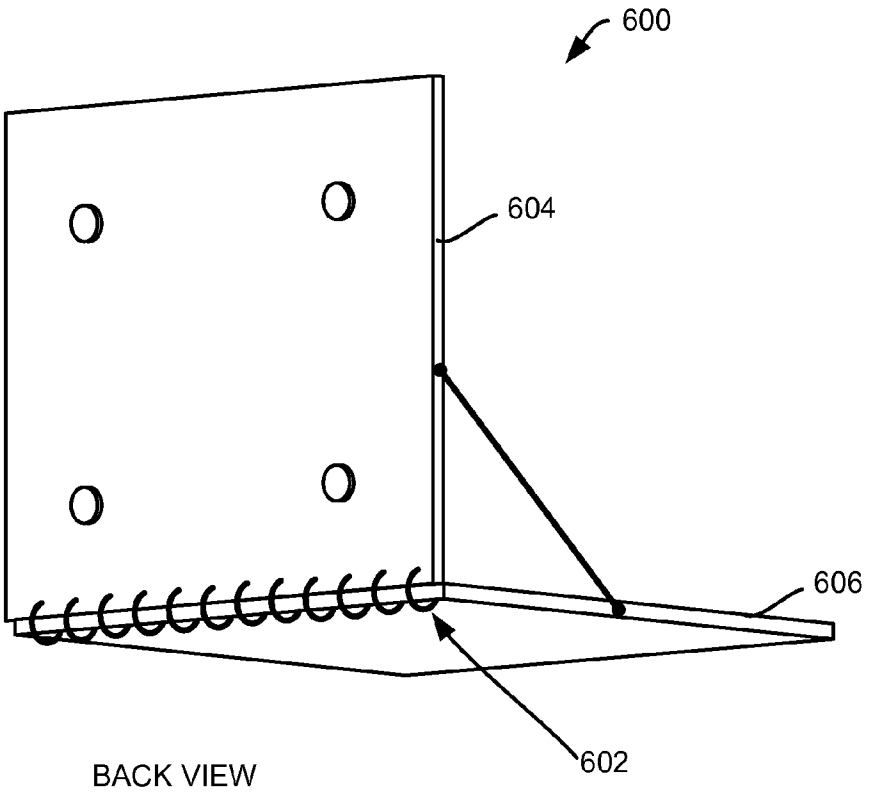

FIG. 6 is an illustrative representation of magnetically mountable tray device 600 in accordance with embodiments of the present invention. In particular, FIG. 6 illustrates a front view and a back view of magnetically mountable tray device 600 having a further hinge example. In the example illustrated, ring hinge 602 may include any number of rings for mechanically coupling mounting plate 604 with base plate 606. In addition, rings may be manufactured from any suitable material known in the art without departing from embodiments herein. Further, hinges may also include a spiral hinge which may be manufactured from a single length of wire or other rigid or semi-rigid material. Hinges of this nature may be desirable when mounting and base plates are manufactured from a flexible fiber material for example. Such hinges may be further desirable when mounting and base plates are manufactured from fibrous materials such as cardboard, fiberboard, and the like.

Figure 7:
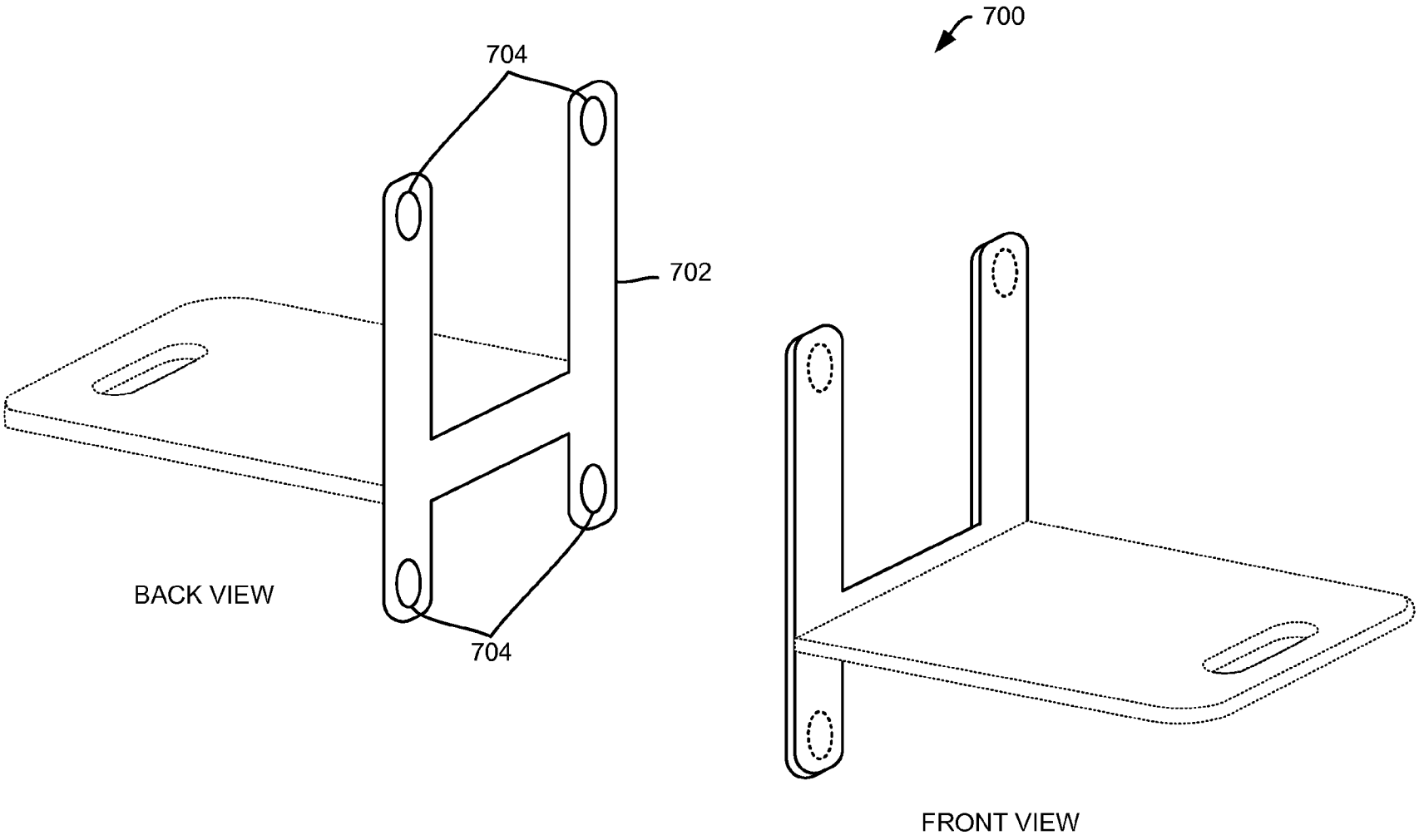
FIG. 7 is an illustrative representation of a magnetically mountable tray device in accordance with embodiments of the present invention.

FIG. 6 is an illustrative representation of magnetically mountable tray device 700 in accordance with embodiments of the present invention. In particular, FIG. 7 illustrates a front view and a back view of magnetically mountable tray device 700. As illustrated, mounting plate 702 may be formed into an "H" pattern. Further, any number of mounting magnets 704 may be provided for mounting magnetically mountable tray device 700) to a magnetically receptive surface. It may be appreciated that, mounting plate embodiments may be formed by any process such as blow molding, injection molding, extrusion molding, cutting, and routing without limitation.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A magnetically mountable tray device comprising:

a mounting plate having a front planar surface and a back planar surface;

a plurality of mounting magnets positioned along the back planar surface;

a base plate having a top planar surface and a bottom planar surface;

a plurality of through-holes positioned along and through the top planar surface;

at least one hinge mechanically coupled along a back edge of the base plate and along the front planar surface of the mounting plate; and at least one support element positioned along the bottom planar surface and mechanically coupled thereto, wherein the at least one support element is positioned to contact the front surface of the mounting plate when the magnetically mountable tray device is in an open position.

2. The magnetically mountable tray device of claim 1, further comprising:

a closure magnet positioned along the front planar surface; and a closure tab positioned along the top planar surface and further positioned to engaged the closure magnet when the magnetically mountable tray device is in a closed position.

3. The magnetically mountable tray device of claim 1, further comprising:

a plurality of capture magnets positioned along and coplanar with the top planar surface.

4. The magnetically mountable tray device of claim 1, further comprising:

a plurality of tray indents positioned along the top planar surface.

5. The magnetically mountable tray device of claim 1, wherein the mounting plate is at least approximately 6 inches wide by at least approximately 6 inches long, and wherein the base plate is at least approximately 6 inches wide by at least approximately 6 inches long.

6. The magnetically mountable tray device of claim 1, wherein the mounting plate and the base plate is manufactured from a material selected from the group consisting of: a non-electrically conductive material, a rigid polymeric material, a semi-rigid polymeric material, a rigid fibrous material, a semi-rigid fibrous material, and a non-ferrous metal material.

7. The magnetically mountable tray device of claim 1, wherein the base plate further comprises a cushioning layer affixed with and at least partially covering the top planar surface.

8. A method for utilizing a magnetically mountable tray device comprising:

providing the magnetically mountable tray device, the magnetically mountable tray device comprising, a mounting plate having a front planar surface and a back planar surface, a plurality of mounting magnets positioned along the back planar surface, a base plate having a top planar surface and a bottom planar surface, a plurality of through-holes positioned along and through the top planar surface;

at least one hinge mechanically coupled along a back edge of the base plate and along the front planar surface of the mounting plate, and at least one support element positioned along the bottom planar surface and mechanically coupled thereto, wherein the at least one support element is positioned to contact the front surface of the mounting plate when the magnetically mountable tray device is in an open position;

attaching the magnetically mountable tray device to a magnetically receptive surface; and moving the magnetically mountable tray device to the open position.

9. The method of claim 8 further comprising:

grasping the base plate;

removing the magnetically mountable tray device from the magnetically receptive surface; and closing the magnetically mountable tray device.

10. The method of claim 8, further comprising:

receiving a magnetically receptive element along any of a plurality of capture magnets positioned along and coplanar with the top planar surface.

11. The method of claim 8, further comprising:

receiving a first object along any of the plurality of through-holes positioned along and through the top planar surface.

12. The method of claim 8, further comprising:

receiving a second object along any of a plurality of tray indents positioned along the top planar surface.

* * * * *